US006468019B1

(12) United States Patent
Duval

(10) Patent No.: US 6,468,019 B1
(45) Date of Patent: Oct. 22, 2002

(54) APPARATUS FOR USE WITH WASTE COMPACTOR/BALER MACHINES

(76) Inventor: Joe Duval, 636 Vallet St., Coalinga, CA (US) 93210

( * ) Notice: Subject to any disclaimer, the term of this patent is extended or adjusted under 35 U.S.C. 154(b) by 0 days.

(21) Appl. No.: 09/927,621

(22) Filed: Aug. 9, 2001

(51) Int. Cl.[7] ..... B30B 15/30

(52) U.S. Cl. ..... 414/416.01; 414/300; 414/416.09; 100/215; 100/255; 198/550.2

(58) Field of Search ..... 414/416.01, 416.09, 414/300; 100/215, 255; 198/550.2

(56) References Cited

U.S. PATENT DOCUMENTS 3,731,616 A * 5/1973 Ligh ..... 100/215 X
4,059,050 A * 11/1977 Davis, Jr. ..... 100/91
4,750,417 A * 6/1988 Newsom et al. ..... 100/215 X
5,218,900 A * 6/1993 Elliott ..... 100/53
5,297,481 A 3/1994 Robbins et al.
5,575,199 A * 11/1996 Yamamoto ..... 100/255 X
6,048,458 A 4/2000 Vogt et al.

* cited by examiner

*Primary Examiner*—Steven A. Bratile
(74) *Attorney, Agent, or Firm*—Richard A. Ryan

(57) ABSTRACT

An apparatus that is made integral with, attached to or attachable to machines for compacting and baling materials, particularly waste materials. The apparatus generally has a hopper compartment and a conveying assembly attached to a frame. The hopper compartment receives waste materials therein. The conveying assembly has a motor driven conveyor belt for conveying the waste materials from the hopper to the compactor/baler machine through an opening in the housing of the machine. Preferably, the first end of the frame attaches to the door that is used for removing compacted bales from the machine, thereby becoming integral with the machine, so as to allow the apparatus to pivot or swing to and from the machine with the opening and closing of the door. Wheels on the second end of the frame facilitate movement of the apparatus along the ground.

20 Claims, 2 Drawing Sheets

APPARATUS FOR USE WITH WASTE COMPACTOR/BALER MACHINES

BACKGROUND OF THE INVENTION

A. Field of the Invention

The field of the present invention relates generally to apparatuses adapted for use with waste recycling and conversion, especially such apparatuses that can be used with waste compactor/baler machines to improve the operation and efficiency thereof. More specifically, this invention relates to an apparatus for transport of waste materials to the compaction/baler compartment of a compactor/baler used to compact, process or bale waste and other materials.

B. Background

It is well known that it is desirable to recycle, convert or process waste for other uses in order to avoid those wastes being disposed in a landfill, incinerated or otherwise disposed of or processed in an environmentally disruptive or unfriendly manner. For recycling or converting of waste to be effective, however, it is necessary that the waste be separated into like materials and prepared for transport to locations where the waste can be processed into new materials, forms or shapes, or converted for other uses, such as for energy production. The waste handling facilities can be located great distances from the location where the waste is separated and prepared for transport. For instance, it is not uncommon that certain waste materials are separated and collected in one state and transported to another state or even a foreign country for recycling or conversion. Preparation of the waste to make transport easier and less expensive is required for efficient waste recycling or conversion.

Although different waste materials may go through different processes of preparing the waste for transport, the principal concern is how to take the loose waste materials that are delivered to the waste handling facilities and prepare them for transport. Generally, the goal is to make the waste materials easier to handle and less costly to transport. The cost of transport is typically a function of the amount of space and weight required on the truck, train or ship used to move the waste to the place where it is finally recycled or converted by the end user. The more expensive it is to handle the waste and transport it between locations, the more costly the reuse of the waste becomes, both to the intermediate user of the waste and to the end user consumer (for those wastes to be recycled or converted into new products). Despite the best intentions of those in the waste recycling or converting industry, if the processing of the recyclable waste becomes too expensive, relative to the use of new raw materials, then it is likely that the recycling and converting of the waste will lessen and result in more wastes being disposed of or incinerated.

To improve the handling capability and reduce the cost of transport for certain wastes, such as plastic, aluminum and steel beverage containers, cardboard products and newspapers, the waste handlers typically compress the waste to reduce the bulk and then bale, wrap or bind it together with string, rope, plastic or steel wire or other materials. This process is often referred to in the industry as densification. As would be expected, the amount of space required to handle or transport a large number of plastic bottles (as an example) can be significantly reduced by compressing the bottles to densify them by removing the air space therein. This is also true, perhaps to a lesser extent, for many other materials. Naturally, because many of the waste materials are to a certain extent elastic, for the compressing to be effective the compressed waste materials must be bound while they are compressed to prevent the material from elastically rebounding, refilling with air, and significantly increasing in size. Binding the materials also makes it much easier, and in most circumstances much less costly, to transport the materials to other locations for further processing.

The typical method of compressing and binding materials is to use a waste compactor/baler machine located at a waste processing facility or, if the machine is portable, at the location of the waste materials. Waste is placed in the compaction chamber of such machines and compressed with a large, flat platen against the chamber walls of the machine so as to compress the waste material. When the compaction chamber is full, the machine either bales or is configured to allow the operator to bale the compressed waste. One such compactor/baler is the portable, upright Brute Force Model 3600 Compactor/Baler made by MaxPak out of St. Paul, Minn. This compactor/baler receives wastes through a front door into the waste handling compartment where it is flattened by a down stroking platen connected to a piston to provide an advertised compaction force of 27,500 pounds or more. As is standard in the industry, this machine compresses waste materials into 200 to 3,000 pound bales through a series of repetitive raising and lowering of the platen so as to compress the waste (lowering) and allow more waste to be input into the compaction chamber. For exporting purposes via ocean transport, the bales should be compressed into 900 pound minimum weights having dimensions of 60" width, 30" length and 48" to 54" height, more or less. In general, for such exportation, the heavier the better.

Although the compactor/baler machines currently in use work well to compact waste materials, there are limitations to the efficiency of the machines used in remote or fixed locations. The efficiency limitations are primarily due to the amount of labor and time it takes to place waste materials into the compaction chamber so that they can be compressed. In addition, there are limitations to the inability of the less powerful and expensive balers to produce the heavier export quality bales. The standard procedure is for the operators to place the waste material into the compaction chamber through the chamber door, operate the machine so as to lower the platen and compress the waste, raise the platen and then open the door to repeat the process. As would be expected, this process is both labor intensive and time consuming. The use of any loading device, such as a conveyor belt assembly has the limitation that the conveyor must be moved out of the way prior to unloading the compacted bale from the machine. As a result of the above inefficiencies, the typical compactor/baler machine can compact and bale approximately four bales per day of plastic beverage containers with one worker to fill the compaction chamber and operate the machine.

What is needed is an apparatus for improving the operation and efficiency of compactor/baler machines so as to reduce the amount of labor and time required to make bales of waste. With such an improved apparatus and machine, the number of bales that can be made by a single compactor/baler machine and worker can significantly increase. The use of such an apparatus should significantly reduce the cost of preparing waste for transport to locations where it can be recycled, converted or processed by end users. The reduced cost of preparing the waste for handling and transport can result in a waste product that is more competitive with the use of new raw materials and will thus ensure the viability of recycling and converting waste materials and enhance governmental efforts to significantly reduce the waste stream volume.

SUMMARY OF THE INVENTION

The apparatus for use with compactor/baler machines of the present invention provides the benefits and solves the problems identified above. That is to say, the present invention discloses a waste compactor/baler machine that includes an apparatus for collecting the waste material and conveying it to the compaction chamber of the compactor/baler machine and a collecting/conveying apparatus that is adapted for use with standard compactor/baler machines, resulting in greater efficiency. Compared to standard compactor/baler machines, which are relatively low volume and discontinuously operated, the machine of the present invention is capable of higher volume (i.e., four times higher volume) and continuous operation. As an example, the present invention is capable of compacting and baling one bale per hour of plastic beverage containers, compared to the three per day for the currently available machines. In addition, the compactor/baler of the present invention is easier to change for compacting and baling one type of material to compacting and baling another type of material.

With regard to the embodiment of a separate collecting/conveying apparatus that attaches to the compactor/baler machine, the apparatus has a frame with a first (upper) end and a second (lower) end, a hopper compartment attached to the frame, a conveying assembly at the bottom of the hopper compartment and attached to the frame, and one or more wheels at the second end of the frame. The first end of the frame is connected to the compactor/baler machine. The hopper compartment is configured to receive waste materials through the top of the hopper compartment. The conveying assembly has a conveyor belt operatively connected to a motor and is configured so as to convey waste materials through from the hopper compartment into an opening provided in the housing of the compactor/baler machine. In the preferred embodiment, the first end of the frame is configured to attach to the door with a bolted connection and move with the door during the opening and closing of the door to eliminate the need to disconnect and remove the apparatus prior to removing the produced bale from the compactor/baler machine. For ease of use, the apparatus can have one or more hook members at the first end of the frame that are configured to attach to the door. The hopper compartment can have a pair of opposing sides and an end, with the sides extending substantially from the first end of the frame to the second end of the frame.

With regard to the embodiment where the collecting/conveying apparatus is provided with the compactor/baler machine, the apparatus can be either removably or fixedly attached to the compactor/baler machine and generally comprise a hopper compartment and a conveying assembly attached to a frame. The hopper compartment should be configured to easily be able to receive waste materials dumped in by an operator. The conveying assembly has a conveyor belt operatively connected to a motor that is used to provide the power for conveying waste material into the compaction chamber. The first (upper) end of the frame is connected to the compactor/baler machine so the conveyor belt can convey waste materials through the opening. The second (lower) end of the frame has one or more wheels attached thereto to allow the apparatus to pivot or swing out away from the machine when the door is open and back into the closed position when the door is closed. One or more hook or hinged members can be provided at the first (upper) end of the frame for attachment to the opening. The hopper compartment can have a pair of opposing sides that extend substantially the full length of the frame and the conveying assembly operation components can be located at the bottom of the hopper compartment. Paddle members can be provided on the conveyor belt to improve operation of the conveyor.

Accordingly, the primary objective of the present invention is to provide an apparatus for use with waste compactor/baler machines that increases the waste handling efficiency of such machines by providing for improved delivery of waste materials into the compaction chamber.

It is also an important objective of the present invention to provide an apparatus for use with waste compactor/baler machines that efficiently and effectively delivers waste materials into such machines to increase the number of bales produced in a given time period.

It is also an important objective of the present invention to provide an apparatus for use with waste compactor/baler machines that utilizes a conveyor system that connects or is integral with the machine so as to speed delivery of waste materials into the compaction chamber.

It is also an important objective of the present invention to provide an apparatus for use with waste compactor/baler machines that allows the operator to load waste materials onto a conveyor system to convey the waste materials to the compaction chamber between strokes of the compactor platen so as to improve the speed of compacting and baling the waste and provide continuous baling.

The above and other objectives of the present invention will be explained in greater detail by reference to the attached figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

With reference to the figures, where like elements have been given like numerical designations to facilitate the reader's understanding of the present invention, the preferred embodiments of the present invention are set forth below. The enclosed figures and drawings are illustrative of the preferred embodiments and represent a preferred way of configuring the present invention. Although specific components, materials, configurations and uses are illustrated, it should be understood that a number of variations to the components and to the configuration of those components described herein and in the accompanying figures can be made without changing the scope and function of the invention set forth herein.

Figure 1:
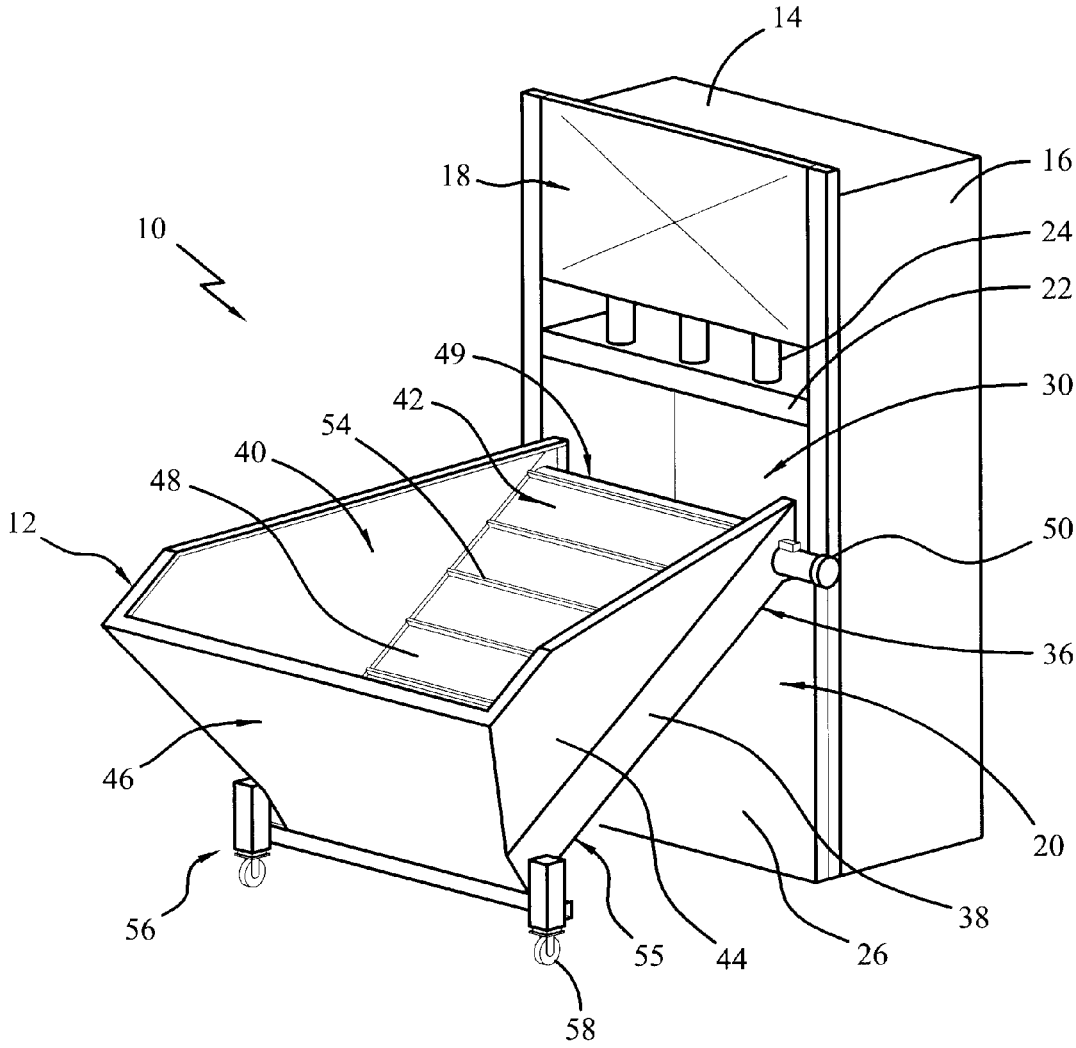
FIG. 1 is a perspective view of a collecting/conveying apparatus of the present invention attached to a typical compactor/baler machine.

An apparatus for use with waste compactor/baler machines encompassing the present invention is shown generally as 10 in the accompanying figures. As best shown in FIG. 1, a collecting/conveying apparatus (the "collector") 12 is attached to a typical waste compactor/baler machine 14. In one embodiment of the present invention, the collector 12 can removably attach to the compactor/baler machine 14 so as to be able to remove collector 12 when not needed for compacting. However, as set forth in the preferred embodiment below, collector 12 can be made to be fixedly attached to machine 14. Additionally, collector 12 can be made to be integral with machine 14 and still accomplish the objectives of the present invention. Compactor/baler machine 14 has a housing 16 with an upper section 18 and a lower section 20. As is well known in the industry, housing 16 is made strong enough to withstand the forces created inside housing 16 by the compaction of the waste material therein. Inside upper section 18 of housing 16 are some of the mechanical and electro-servo components and controls for raising and lowering (ramming) platen 22 one or more times with piston/guide rods 24, placed as needed. As explained in more detail below, platen 22 is driven or rammed downward into lower section 20 to compress materials, such as plastic bottles, cardboard, aluminum cans, steel cans or other materials into densified bales of waste.

A hinged door 26 in lower section 20 is openable to allow the compacted waste materials to be removed from the compaction chamber (shown as 28 in FIG. 2) in lower section 20 after the bales are produced. In the preferred embodiment, door 26 is hingedly attached to housing 16 with hinges 27 so that door 26 may swing open. As described in more detail below, collector 12 is attached to door 26 such that when door 26 is swung open, collector 12 swings with door 26. Compaction chamber 28 is formed by the sides and bottom of housing 16 and the underside of platen 22. At the top of door 26, as shown in FIG. 1, is an opening 30 into the interior of lower section 20 of housing 16 and compaction chamber 28 (when the platen 22 is above opening 30). In the prior art, waste materials are typically manually drop fed into the compactor/baler machine 14 through opening 30 after the platen 22 completes the upstroke (i.e., after compressing the waste materials in compaction chamber 28). In use, the prior art apparatus of compacting waste materials includes raising platen 22 to its upper most position, manually throwing or placing the waste materials into compaction chamber 28 through opening 30 in door 26, activating machine 14 to lower or ram platen 22 so as to compress the waste material in chamber 28 to as much of a compressed condition as possible, and raising platen 22 to repeat the above-described cycle. The typical compressor/baler machine 14 has automated safety controls that prevent the machine 14 from operating unless door 26 is completely closed. Some machines 14 have a second door (not shown in illustrations) to close opening 30 after materials are thrown into compaction chamber 28. Although door 26 is typically located under opening 30 (i.e., such that it forms the bottom edge 32 of opening 30) at the front side of machine 14, either door 26 and/or opening 30 can be located on any of the sides, including the back side, of machine 14 as is desirable.

Figure 2:
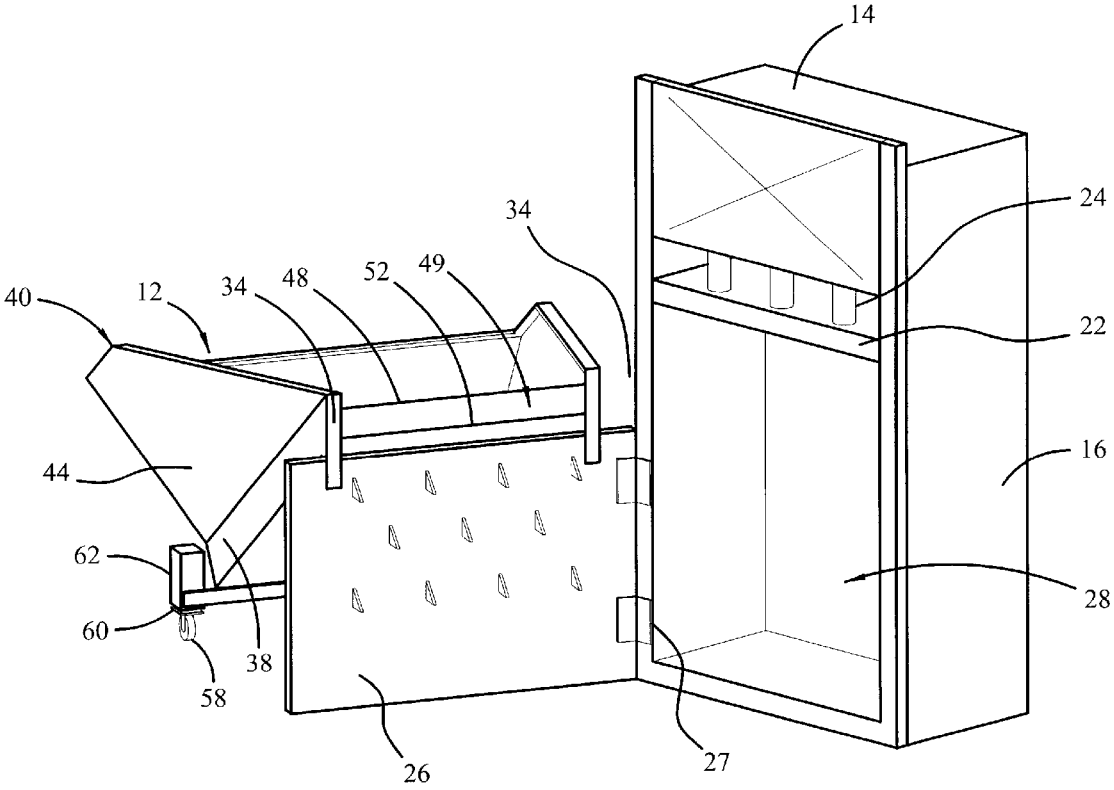
FIG. 2 is a perspective view of the collecting/conveying apparatus of the present invention shown attached to an open door of a typical compactor/baler machine.

In one embodiment of the present invention, collector 12 attaches to the bottom edge 32 of opening 30, as best shown in FIG.2, utilizing a pair of hook members 34 at the first (upper) end 36 of frame 38 which slide over the top of edge 32 to anchor collector 12 to machine 14. The use of hook members 34 is one of many mechanisms that can be used to connect collector 12 to machine 14. For instance, the "hook" portion of hook members 34 could extend the entire width of edge 32. Collector 12 can be bolted, screwed, welded, riveted or by other connectors connected directly to machine 14. By connecting collector 12 to the bottom edge 32 of opening 30, which in the accompanying figures is the top of door 26, the collector 12 can pivot or swing open with door 26 as door 26 is opened to remove the compacted bale of waste. In this manner, collector 12 is not in the operator's way when it is necessary to remove compacted material from machine 14. As set forth in detail below, collector 12 can be provided with wheels or other devices for allowing collector 12 to be easily swung out of the way by a single person when opening door 26 along the designed arc (door 26 movement).

Collector 12 has an attached hopper compartment 40 and a conveyor belt assembly 42 attached to frame 38 for receiving and conveying material into the compaction chamber 28 of machine 14. Hopper 40 comprises a pair of opposing hopper sides 44 and a hopper end 46 attached to or integral with frame 38, as best shown in FIG. 1. Hopper sides 44 and end 46 form a hopper compartment 40 that one or more persons can easily dump, either by hand or utilizing various available machinery, waste material therein. The open top of hopper 40 is configured to allow the operator to be able to continually dump or feed waste into hopper 40 without the difficulty associated with attempting to dump the waste through opening 30 in order to charge compaction chamber 28. Hopper 40 should be large enough such that it can contain a significant amount of waste such that, as explained below, the compaction chamber 28 can be provided with new material to compress (i.e., charged) as it completes each compaction cycle (i.e., a single platen down motion to compress the waste followed by an upward motion after compression). Hopper 40 can also comprise a cover or lid (not shown) if desired.

Conveyor assembly 42 includes a conveyor belt 48 at the inside bottom of hopper 40, a small motor 50 to drive conveyor belt 48, roller assembly 49 at the first (upper) end of hopper 40 and edge cover 52. Conveyor belt 48 can be made to be as wide as the bottom of hopper 40 or the width of opening 30, which typically will be approximately three to five feet wide. In the preferred embodiment, conveyor belt 48 is approximately three feet wide, to reduce the cost of conveyor assembly 42 and collector 12, although it could be as wide as opening 30. Roller assembly 49 comprises a roller having a ball bearing housing to allow conveyor belt 48 to roll around the first end 36 as material is carried upward by conveyor belt 48 into opening 30. Conveyor belt 48 is driven in an upward incline direction by motor 50, which can be located on either side of hopper 40, to carry waste material through opening 30 and into compaction chamber 28 so that the material may be compressed by platen 22 against the bottom of compactor/baler 14. The operation of motor 50 moves the waste material up to opening 30 along conveyor belt 48. To provide improved movement of waste material, paddle members 54 can be placed on belt 48 so as to more effectively deliver the waste products into compaction chamber 28. The paddle members 54 can be of the type that are made of molded rubber, plastic, metal and/or impregnated fiber so as to be sufficiently strong to move material upward to opening 30. In the preferred embodiment, each of the paddle members 54 on conveyor belt 48 may be skewed from the parallel position (relative to opening 30) so that the material conveyed upward by conveyor belt 48 will not all enter opening 30 at the same time. When paddle members 48 are skewed, the material on one side of opening 30 will enter opening 30 prior to the material at the other side.

At the interface of the belt 48 and opening 30 can be provided edge cover 52 which extends in a generally downward direction from first end 36 of frame 38 to overlap or cover the bottom edge 32 of opening 30. Edge cover 52 prevents any waste material that happens to stick to belt 48 after belt 48 traverses the curve at roller assembly 49 to deposit the waste into opening 30 from getting trapped between the bottom edge 32 of opening 30 and belt 48 or frame 38, where it could possibly jamb or otherwise interfere in the operation of conveyor assembly 42. Motor 50 can be a small electric motor (i.e., ¼th horsepower) or other types of motors suitable for the conditions and power requirements where apparatus 10 will be used. The motor 50 connects or otherwise interacts with various power transmission components, as is well known in the art, to. operate conveyor belt 48. If desired, motor 50 can be provided with an emergency shut-off button or switch to allow the operator to shut-down the conveyor belt 48 as rapidly as possible in case of an emergency. Alternatively or in addition, apparatus 10 can be provided with an automatic shut-off device that shuts down motor 50 as soon as compaction chamber 28 is filled (i.e. when the waste material in compaction chamber 28 fills to the level of the platen 22 when in the raised or open position).

Attached to or integral with the second end 55 of frame 38 is a wheel assembly 56 having one or more wheels 58. In the preferred embodiment of the present invention 10, as best shown in FIG. 1, there is a separate wheel assembly 56 at each side of the second end 55 of frame 38 with one wheel 58 rotatably attached to each assembly 56. Wheel 58 can be a standard rotating wheel as commonly known in the industry that is attached to a base 60 that is inserted into tubular member 62 in a manner that allows wheel 58 to rotate around for the direction of travel necessary to swing the collecting/conveying apparatus 12 to or away from machine 14, preferably with the motion of door 26. Wheel assembly 56 can include an internal spring-loaded mechanism that rolls across the ground to make it easier to open and close door 26. The wheel assembly should be configured so that machine 14 will not have a tendency to tip over due to the weight and/or movement of collector 12.

Conveyor belt systems, such as those available from Prodeva, Inc. out of Jackson Center, Ohio, can be modified as described above to include hopper 40 on frame 38 with wheel assembly 56. Although various companies provide conveyor belt systems suitable for placing next to and utilization in conjunction with a waste compacter/baler machine 14 (commonly referred to as baler infeeders), none of the known baler infeeders provide the various aspects and benefits of the present invention. Specifically, none of the prior art devices connect to, or provide for a connection to, the compactor/baler machine, are configured in such a way that allows movement of the collecting/conveying apparatus 12 by the opening of door 26 to remove bales of waste or have a full length hopper 40 to facilitate transport of waste to inside compaction chamber 28 through opening 30, as well as other aspects of the present invention. The complete apparatus 10 of the present invention improves the overall efficiency and, therefore, significantly increases the usefulness of compactor/baler machines 14.

In use, the apparatus 10 of the present invention is connected or attached to a compactor/baler machine 14 in either a removable manner (i.e., by placing hook members 34 over bottom edge 32 of opening 30) or in a fixed manner by bolting, screwing or welding apparatus 10 to machine 14. Waste material is placed or dumped into the hopper compartment 40 by the operator, in a manner that is both faster and easier than placing the waste material through opening 30 directly (as done in the prior art). Both the collector 12 and machine 14 are activated, and the platen 22 is placed in a raised position. Waste material from hopper 40 is transported upward by conveyor belt 48 and, if used, the paddle members 54 on belt 48. The waste material is carried upward and through opening 30 into compaction chamber 28 to charge chamber 28 for compaction. At various intervals, platen 22 is lowered to crush or compact the waste materials in compaction chamber 28 to densify the waste. While the platen 22 is compacting the waste, the operator can continue to charge the hopper 40 by adding more waste. After compacting the waste in compaction chamber 28, platen 22 is raised and additional waste material is transported into compaction chamber 28 for compaction until compaction chamber 28 is substantially full of compacted waste material or the downward hydraulic pressure exerted by platen 22 reaches a predetermined level (such as 2700 psi), as determined by market conditions. The compacted (or densified) waste is bundled so as to maintain its compacted shape and retain any loose materials. The bundled waste is removed, typically by using a forklift or like device, and placed on a truck, rail car or other device for transport to where it will be recycled, converted, as processed further by others.

Use of the apparatus 10 of the present invention significantly improves the efficiency of the use of waste compactor/baler machines 14. For instance, prior to using the apparatus 10 the inventor was able to generate only two to four bales of compacted matter per day utilizing one worker, whereas in field tests of the apparatus 10 he has found that a single operator is able to generate up to one bale per hour. The apparatus 10 of the present invention can be made to be a stand-alone unit that is suitable for attachment and use with currently available compactor/baler machines 14. Alternatively, new machines 14 can be manufactured and sold with the apparatus 10 configured to be part of the new machine 14. Further improvements in efficiency may be possible from using more switches and controls of electrical and electronic types.

Alternative configurations are possible for the present invention 10. For instance, first end 36 of frame 38 can attach to various places on machine 14 (i.e., first end 36 can attach above opening 30 or below opening 30) as long as the collecting/conveying apparatus 12 is configured so the conveyor belt 48 delivers the waste material into the compaction chamber 28, typically through the opening 30 in housing 16. Opening 30 can be in the housing 16 or integral with door 26. Opening 30 can include a door member (not shown) that can slide up and down and be configured to operate with the movement of platen 22. As the platen 22 raises, the door member would slide open to allow waste material to be placed inside compaction chamber. As the platen 22 moves downward to compress the waste, the door member would slide closed to prevent waste from being placed above platen 22. The conveyor belt 48 could continue to run, with the waste material merely piling up behind the door member.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use. For instance, there are numerous components described herein that can be replaced with equivalent functioning components to accomplish the objectives of the present invention. One such modification is the use of different materials than those set forth herein. Another modification would be a change in the dimensional characteristics of the various components.

What is claimed is:

1. A waste compactor/baler apparatus for compacting a quantity of waste materials, comprising:

a compactor/baler machine having a housing forming a compaction chamber therein, a platen for compacting the waste materials in said compaction chamber and a door for removing the compacted waste materials from said compaction chamber, said compactor/baler machine having an opening for receiving the waste materials into said compaction chamber; and a collecting/conveying apparatus attached to said compactor/baler machine, said collecting/conveying apparatus having a hopper compartment and a conveying assembly attached to a frame, said hopper compartment configured to receive waste materials therein, said conveying assembly having a conveyor belt operatively connected to a motor, said frame having a first end and a second end, said first end of said frame connected to said compactor/baler machine so said conveyor belt can convey waste materials through said opening, said second end of said frame having one or more wheels attached thereto.

2. The waste compactor/baler apparatus according to claim 1, wherein said collecting/conveying apparatus is attached to and configured to move with said door during the opening and closing of said door.

3. The waste compactor/baler apparatus according to claim 1, wherein said collecting/conveying apparatus is removably connected to said compactor/baler machine.

4. The waste compactor/baler apparatus according to claim 1, wherein said collecting/conveying apparatus is fixedly attached to said compactor/baler machine.

5. The waste compactor/baler apparatus according to claim 1, wherein said opening is in said door and said first end of said frame is attached to said opening.

6. The waste compactor/baler apparatus according to claim 1, further comprising one or more hook members at said first end of said frame, said one or more hook members configured to attach to said opening.

7. The waste compactor/baler apparatus according to claim 1, wherein said hopper compartment includes a pair of opposing sides and an end, said pair of opposing sides extending substantially from said first end of said frame to said second end of said frame.

8. The waste compactor/baler apparatus according to claim 1, wherein said conveying assembly is disposed at the bottom of said hopper compartment.

9. The waste compactor/baler apparatus according to claim 1, wherein said conveyor belt has one or more paddle members thereon.

10. The waste compactor/baler apparatus according to claim 9, wherein said one or more paddle members are skewed on said conveyor belt.

11. The waste compactor/baler apparatus according to claim 1 further comprising a wheel assembly at said second end of said frame, said wheel assembly having said wheels attached thereto.

12. A waste compactor/baler apparatus for compacting a quantity of waste materials, comprising:

a compactor/baler machine having a housing forming a compaction chamber therein, a vertically moveable platen for compacting the waste materials in said compaction chamber and a door hingedly attached to said housing for removing the compacted waste materials from said compaction chamber, said compactor/baler machine having an opening for receiving the waste materials into said compaction chamber; and a collecting/conveying apparatus attached to said compactor/baler machine and configured to move with said door during the opening and closing of said door, said collecting/conveying apparatus having a hopper compartment and a ramped conveying assembly attached to a frame, said hopper compartment configured to receive waste materials therein, said conveying assembly having a conveyor belt operatively connected to a motor, said frame having a first end and a second end, said first end of said frame configured to attach to said opening so said conveyor belt can convey waste materials through said opening, said second end of said frame attached to a wheel assembly having one or more wheels.

13. The waste compactor/baler apparatus according to claim 12, wherein said hopper compartment includes a pair of opposing sides and an end, said pair of opposing sides extending substantially from said first end of said frame to said second end of said frame.

14. The waste compactor/baler apparatus according to claim 12, wherein said conveying assembly is located at the bottom of said hopper compartment.

15. A collecting/conveying apparatus in combination with a waste compactor/baler apparatus for compacting a quantity of waste materials, said compactor/baler machine having a housing forming a compaction chamber therein, a platen for compacting the waste materials in said compaction chamber and a door for removing the compacted waste materials from said compaction chamber, said compactor/baler machine having an opening in said housing or said door for receiving the waste materials into said compaction chamber, said collecting/conveying apparatus comprising:

a frame having a first end and a second end, said first end of said frame connected to said compactor/baler machine;

a hopper compartment attached to said frame, said hopper compartment configured to receive waste materials therein;

a conveying assembly at the bottom of said hopper compartment and attached to said frame, said conveying assembly having a conveyor belt operatively connected to a motor, said conveyor belt configured so as to convey waste materials through from said hopper compartment to said opening; and one or more wheels at said second end of said frame.

16. The collecting/conveying apparatus according to claim 15, wherein said first end of said frame is configured to attach to said door and move with said door during the opening and closing of said door.

17. The collecting/conveying apparatus according to claim 16, further comprising one or more hook members at said first end of said frame, said one or more hook members configured to removably attach to said door.

18. The collecting/conveying apparatus according to claim 15, wherein said frame is removably connected to said compactor/baler machine.

19. The collecting/conveying apparatus according to claim 15, wherein said frame is fixedly attached to said compactor/baler machine.

20. The collecting/conveying apparatus according to claim 15, wherein said hopper compartment includes a pair of opposing sides and an end, said pair of opposing sides extending substantially from said first end of said frame to said second end of said frame.

* * * * *